US005389025A

United States Patent [19]

Vanceulen et al.

[11] Patent Number: 5,389,025

[45] Date of Patent: Feb. 14, 1995

[54] METHOD OF MANUFACTURING A MAGNETICALLY SPLIT INTERNAL MAGNETIC SHIELD FOR A DISPLAY TUBE

[75] Inventors: Richard Vanceulen; Wilhelmus J. Beekmans; Henricus P. Van Der Vijfeyke, all of Eindhoven, Netherlands

[73] Assignee: U.S. Philips Corporation, New York, N.Y.

[21] Appl. No.: 241,076

[22] Filed: May 10, 1994

Related U.S. Application Data

[62] Division of Ser. No. 898,982, Jun. 15, 1992.

[30] Foreign Application Priority Data

Jun. 14, 1991 [EP] European Pat. Off. ..... 91201474

[51] Int. Cl.[6] ..... H01J 9/236

[52] U.S. Cl. ..... 445/1; 228/155; 228/189

[58] Field of Search ..... 445/1; 228/155, 189

[56] References Cited

U.S. PATENT DOCUMENTS

| | | | |
|---|---|---|---|
| 2,458,645 | 1/1949 | Rosenberg et al. | 228/155 |
| 3,238,610 | 3/1966 | Berg | 228/155 |
| 4,758,193 | 7/1988 | Brown | 445/1 |

FOREIGN PATENT DOCUMENTS

| | | | |
|---|---|---|---|
| 0403010A1 | 12/1990 | European Pat. Off. . | |
| 52-18165 | 2/1977 | Japan | 445/1 |

*Primary Examiner*—P. Austin Bradley
*Assistant Examiner*—Jeffrey T. Knapp
*Attorney, Agent, or Firm*—Paul R. Miller

[57] ABSTRACT

A method of manufacturing a magnetically split internal magnetic shield (19) which comprises two complementary parts (15) and (16). Two plate-shaped parts (15') and (16') of a ferromagnetic material are arranged next to each other at a distance d and welded together by means of a strip of a non-magnetic metal. Subsequently, an internal magnetic shield is formed from the twin plate by means of drawing, cutting and/or bending.

1 Claim, 3 Drawing Sheets

METHOD OF MANUFACTURING A MAGNETICALLY SPLIT INTERNAL MAGNETIC SHIELD FOR A DISPLAY TUBE

This application is a divisional application of U.S. application Ser. No. 07/898,982, filed Jun. 15, 1992, and all benefits of such earlier application are hereby claimed for this divisional.

The invention relates to a method of manufacturing a magnetically split internal magnetic shield for a display tube.

The invention also relates to a display tube and particularly to a display tube having a shield obtainable by such a method.

The magnetically split internal magnetic shield is a shield having two complementary magnetic parts arranged at a short distance opposite each other. It is used to shield electron beams generated in a display tube from external magnetic fields such as, for example, the earth's magnetic field. A desired magnetic shielding is realised by adjusting the distance between the two magnetic parts.

It is known from Abstracts of Japanese Patents, Vol. 35 (1988), page E624,JP-88/13238 to manufacture a (funnel-shaped) shield which is cut into two parts. The two parts of the magnetic shield are separately secured to a supporting frame of a shadow mask. The facing ends of the parts are connected together by means of strips of frit glass or similar material.

However, practice has proved that notably in display tubes having larger dimensions a problem during the connection step is to accurately adjust the distance between the ends of the parts which are deep-drawn from thin sheet material (0.15 mm).

It is one of the objects of the invention to provide a method of manufacturing a split internal magnetic shield having two complementary parts arranged at a small distance opposite each other, in which method the shield is manufactured in a simple manner without the distance between the two parts being subject to variations.

According to the invention a method of the type described in the opening paragraph is therefore characterized in that two flat plate-shaped parts of a ferromagnetic material are arranged next to each other and (while being held accurately in position with respect to each other) are welded together by means of a strip of a non-magnetic metal, whereafter an internal magnetic shield is formed from the twin plate by means of deep drawing, and possible subsequent operations such as cutting and/or bending.

The invention also relates to a shield manufactured by means of this method, and to a display tube provided with such a shield.

Figure 1:
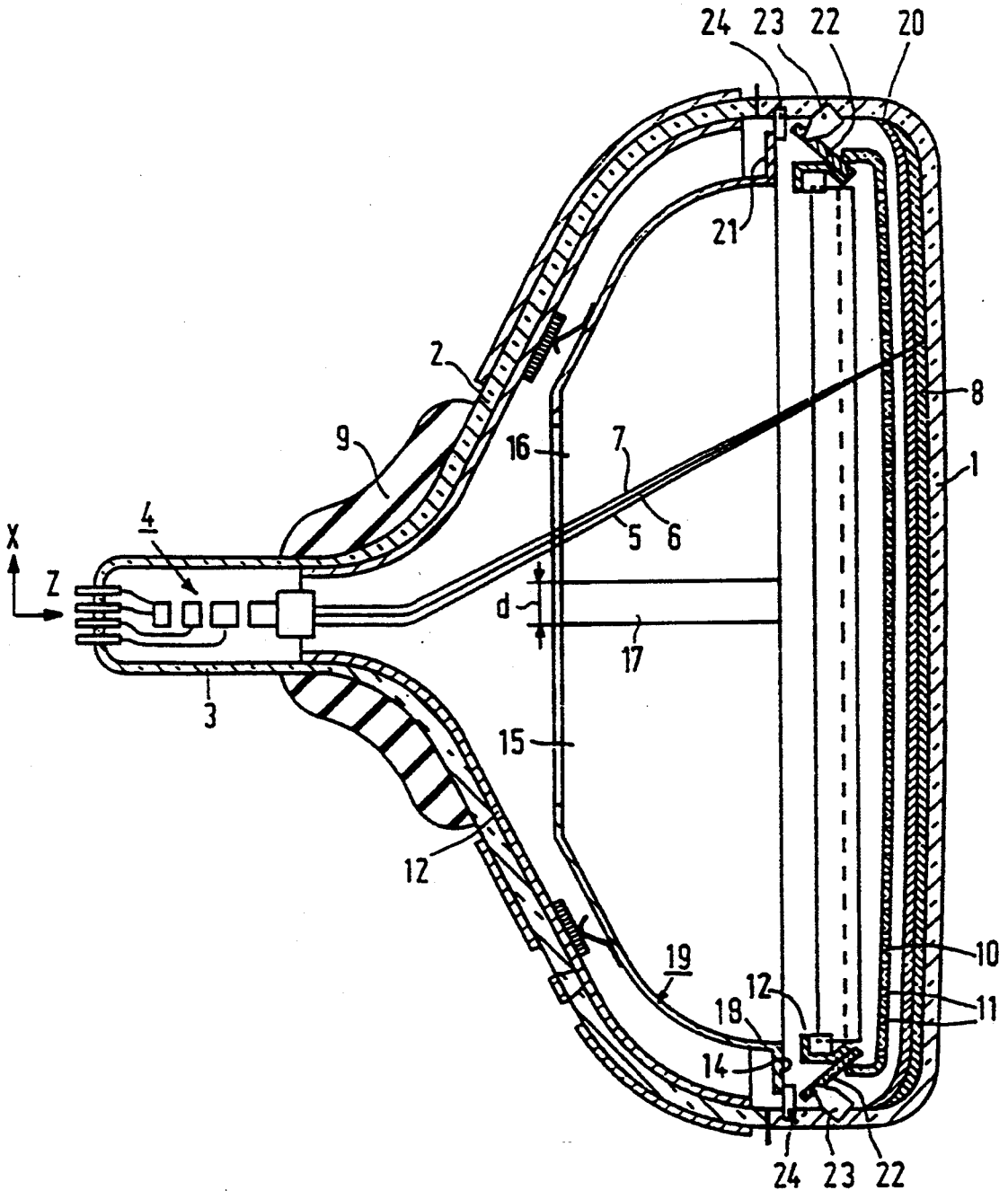
Figure 2:
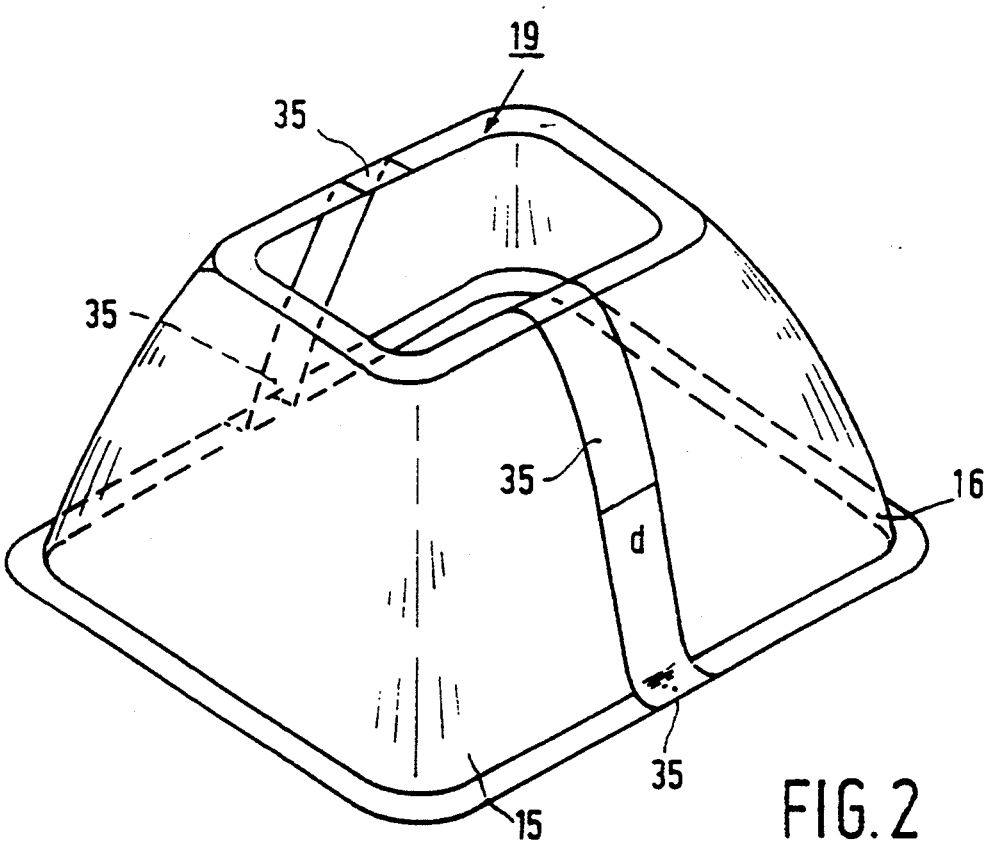

These and other aspects of the invention will be elucidated with reference to the embodiments described hereinafter and the drawings in which FIG. 1 is a diagrammatic cross-section of a display tube provided with a split internal magnetic shield, FIG. 2 is a diagrammatic perspective view of an embodiment of a magnetic shield according to the invention; and FIGS. 3, 4, 5 and 6 show successive stages of a manufacturing process for a split magnetic shield.

The colour display tube shown in a cross-sectional view in FIG. 1 comprises an envelope having a substantially rectangular display window 1, a cone 2 and a neck

3. The neck 3 accommodates an electrode system 4 with three electron guns for generating three electron beams 5, 6 and 7. The electron beams are generated in one plane (here the plane of the drawing) and are directed onto a display screen 8 arranged internally on the display window 1 and comprising a large number of red, green and blue-luminescing phosphor elements coated with an aluminium layer 20. The phosphor elements are, for example, strip-shaped and the longitudinal direction of the strip-shaped elements is perpendicular to the plane through the electron guns (here the plane of the drawing). On their way to the display screen 8 the electron beams 5, 6 and 7 are deflected across the display screen 8 by means of a plurality of deflection coils 9 arranged coaxially around the tube axis and pass a shadow mask 10 comprising a thin metal plate having apertures 11 whose longitudinal direction is parallel to the phosphor elements of the display screen 8. The three electron beams 5, 6 and 7 pass the apertures 11 at a small angle relative to each other and consequently each impinge on phosphor elements of one colour only. A two-part internal magnetic shield 19 having a substantially rectangular widest end and being bowl-shaped in this embodiment is provided in FIG. 2 with a flange 21. The two-part internal shield 19 reduces the detrimental effects of external magnetic fields such as, for example, the earth's magnetic field on the path of the electron beams. In this embodiment the internal magnetic shield 19 is secured to a supporting element 24 by means of a flange 21 in each corner. The internal shield 19 comprises two complementary parts 15, 16 which are arranged opposite each other at a distance d and connected together with a continuous non-magnetic strip 35. The distance d is adjusted to obtain a desired shielding action. (In this case the shadow mask 10 is secured to a frame which is suspended from supporting pins 23 via resilient means 22). The shield 19 may also be supported by these supporting pins or, like the shadow mask, may be secured to the frame.

Figure 3:
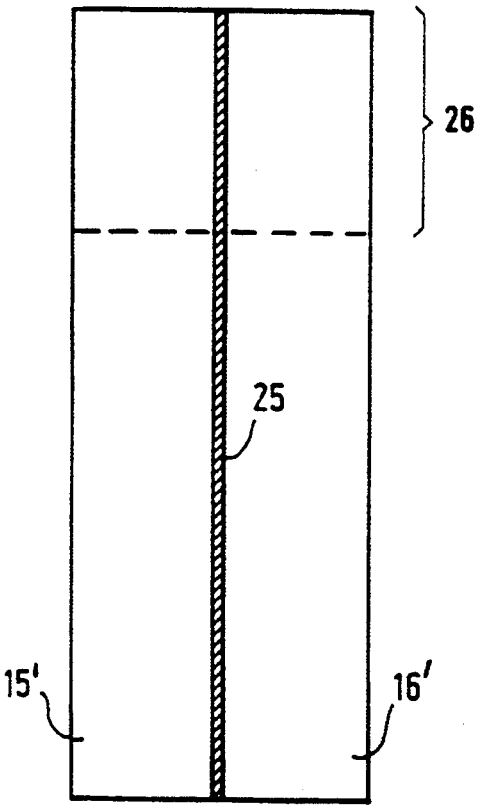
Figure 4:
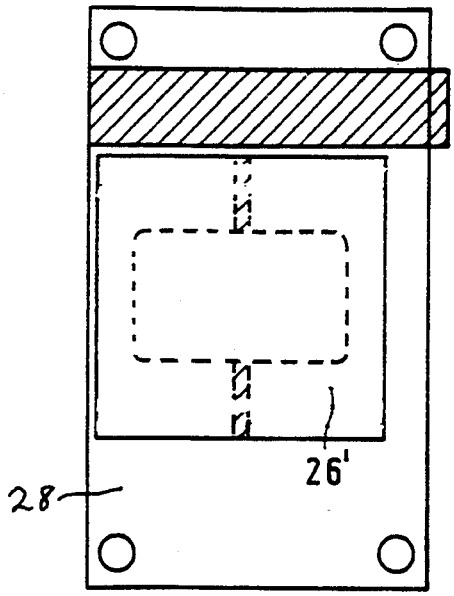
Figure 5:
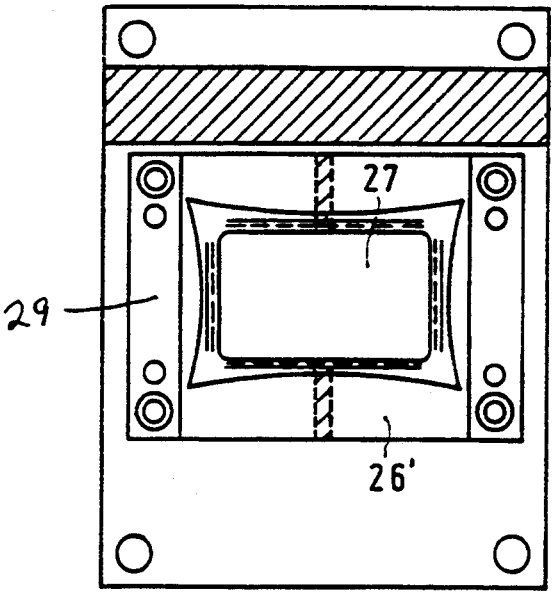

The method according to the invention simply provides an accurate and permanent adjustment of the distance d. As is shown in FIG. 3 the facing edges of two flat plate-shaped parts 15' and 16' of a soft magnetic material are spaced apart by a gap of a small distance, such as several mm, for example, about 3 mm, and welded together by means of a strip 25 of a non-magnetic metal, for example, a nickel-chromium steel such as Cr—Ni 18/12. The non-magnetic strip 25 has a width of about 10 mm, for example, and is placed over the gap and welded to the plates 15' and 16' by means of point welding to form a "twin-plate". The parts 15' and 16' can be supplied continuously and after a welding step over a given part of the length a twin plate portion 26 can be cut from the "twin-plate" a number of successive times. A twin plate 26 thus obtained can subsequently be placed over the lower portion 28 of a drawing press and be subjected to a deep-drawing process in the drawing press (FIG. 4). Then, for example, the basic shape of a truncated, rectangular or bowl shaped cone 26' thus obtained is subsequently subjected to a cutting process in a cutting press (FIG. 5), in which process, inter alia, an aperture 27 for passing the electron beams is formed in the truncated part.

Figure 6:
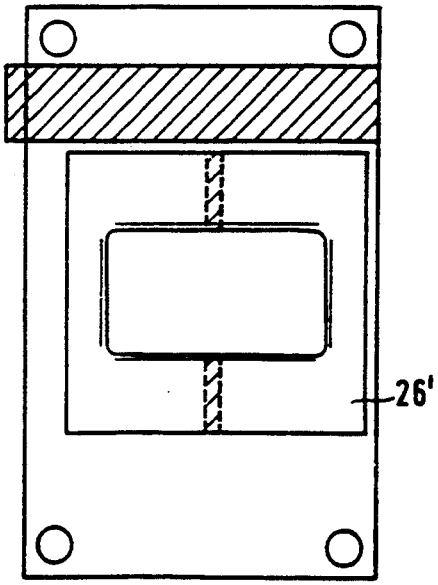

Subsequently, a bending process in which, inter alia, the edges of the electron beam aperture 27 are bent may be performed in a bending press (FIG. 6).

The magnetically split shield thus obtained can be secured to the frame on which the shadow mask is arranged, for example, by means of clamping springs or by spot-welding. The advantage of a shield manufactured by means of the method according to the invention is that it is considerably less sensitive to vibrations than a construction comprising two separate complementary halves and thus transmits fewer vibrations to the shadow mask.

However, if the transmission of vibrations is to be prevented to a maximum extent by suspending the shadow mask and the shield mechanically decoupled from each other in the display tube, the shield constituting a mechanical assembly manufactured by means of the method according to the invention also provides an important advantage. A shield constituting a mechanical assembly can be suspended in a simpler and better way than a shield consisting of two separate complementary parts, even in the case where these complementary parts are secured together by means of the connection strips bridging the gap.

We claim:

1. A method of manufacturing a magnetically split internal magnetic shield for a display tube, comprising arranging two flat plate-shaped parts of a ferromagnetic material next to each other, welding the two flat plated-shaped parts together by means of a strip of a non-magnetic metal, and forming an internal magnetic shield from the two welded flat plate-shaped parts by means of drawing.

* * * * *